US005222143A

United States Patent [19]

Min

[11] Patent Number: 5,222,143

[45] Date of Patent: Jun. 22, 1993

[54] COMPATIBLE MULTIVOICE BROADCASTING RECEIVER

[75] Inventor: Byeong-uk Min, Kwangmyeong, Rep. of Korea

[73] Assignee: SamSung Electronics Co., Ltd., Suwon, Rep. of Korea

[21] Appl. No.: 730,003

[22] Filed: Jul. 15, 1991

[30] Foreign Application Priority Data

Aug. 14, 1990 [KR] Rep. of Korea ..... 90-12294

[51] Int. Cl.[5] ..... H04H 5/00

[52] U.S. Cl. ..... 381/4; 358/144

[58] Field of Search ..... 381/2-4, 381/14; 358/144

[56] References Cited

U.S. PATENT DOCUMENTS 4,688,252 8/1987 Kufta et al. ..... 381/4

4,716,589 12/1987 Matsui ..... 381/3

*Primary Examiner*—Forester W. Isen

*Attorney, Agent, or Firm*—Robert E. Bushnell

[57] ABSTRACT

A compatible multivoice broadcasting receiver is disclosed which can receive both Korean multivoice broadcasting and American multivoice broadcasting and commonly process the one-carrier component (L+R) of Korean multivoice broadcasting and the main channel signal (L+R) of American multivoice broadcasting. In addition to the existing multivoice broadcasting receiver, the multivoice broadcasting receiver further comprises a buffer section that operates the outputs L+R signal detector, L−R and SAP signal detector, and the L−R and pilot signal detector selectively under the control of a buffer driving section, the buffer driving section operating a buffer section, an analog switch section for switching the signal transmission according to the output signal from the buffer driving section, and a matrix section for matrix-operating the output signals from the buffer section according to the output signal from the analog switch section and for outputting the left channel signal and the right channel signal.

7 Claims, 2 Drawing Sheets

COMPATIBLE MULTIVOICE BROADCASTING RECEIVER

BACKGROUND OF THE INVENTION

The present invention relates to a compatible multivoice broadcasting receiver, and particularly to the multivoice broadcasting receiving apparatus having a common processing circuit for both one-carrier component L+R of a Korean multivoice system and main channel signal L+R of a American multivoice broadcasting system and which selectively receives the Korean and American multivoice broadcasting system.

Generally, the Korean multivoice broadcasting system adopts two carrier system that transmits a main channel signal L+R on an existing first audio channel, and transmits a bilingual broadcasting signal (hereinafter referred to as a BIL signal) and a pilot signal which is a distinction signal that distinguishes the bilingual broadcasting signal and the stereo broadcasting signal on a second audio channel for use with the multivoice broadcasting system. However, the American multivoice broadcasting system transmits a main channel signal L+R, a stereo broadcasting signal L−R, a SAP (Second Audio Program) signal for the bilingual broadcasting and a telemetry signal for telemetering, on one channel.

SUMMARY OF THE INVENTION

It is, therefore, an object of the present invention to provide a compatible multivoice broadcasting receiving apparatus that can receive both the Korean and American multivoice broadcasting system selectively by utilizing a common processing circuit for both the one-carrier component L+R of the Korean multivoice broadcasting system and the main channel signal L+R of the American multivoice broadcasting system.

To achieve the above stated object, the compatible multivoice broadcasting receiver according to the present invention to process in common one carrier component L+R of one multivoice broadcasting system and a main channel signal, that is, a sum signal L+R of a left channel signal L and a right channel signal R, of the other multivoice broadcasting system, is characterized by comprising;

a 4.5 MHz band pass filter that receives an audio signal and filters the audio signal into a 4.5 MHz frequency band;

a 4.72 MHz band pass filter that receives the audio signal and filters the audio signal into a 4.72 MHz frequency band;

an L+R signal detector that receives the output signal from the 4.5 MHz band pass filter and detects the sum signal L+R of the left channel signal and the right channel signal, that is, the signal that designates the main channel signal;

an L−R and SAP signal detector that receives the output signal from the 4.5 MHz band pass filter and detects the difference signal L−R of the left channel signal L and the right channel signal R for a stereo broadcast, and the SAP (Second Audio Program) signal for a bilingual broadcast;

an L−R and pilot signal detector that receives the output signal from the 4.72 MHz band pass filter and detects the difference signal L−R of the left channel signal and the right channel signal for a stereo broadcast or bilingual broadcast and the pilot signal that distinguishes among the stereo broadcasting and bilingual broadcasting;

a buffer section that receives the outputs from the L+R signal detector, the L−R and SAP signal detector and the L−R and pilot signal detector and manages the received signals to be selectively outputted under the control of the buffer driving section;

a buffer driving section to drive the buffer section;

an analog switch section that opens and closes the signal transmission according to the output signal from the buffer driving section; and a matrix section that matrix-operates the output signals from said buffer section according to a control signal output from the analog switch section and outputs the left channel signal L and the right channel signal R.

DETAILED DESCRIPTION OF THE PREFERRED EMBODIMENT

A preferred embodiment of the compatible multivoice broadcasting receiver according to the present invention will be described below with reference to the accompanying drawings.

Figure 1:
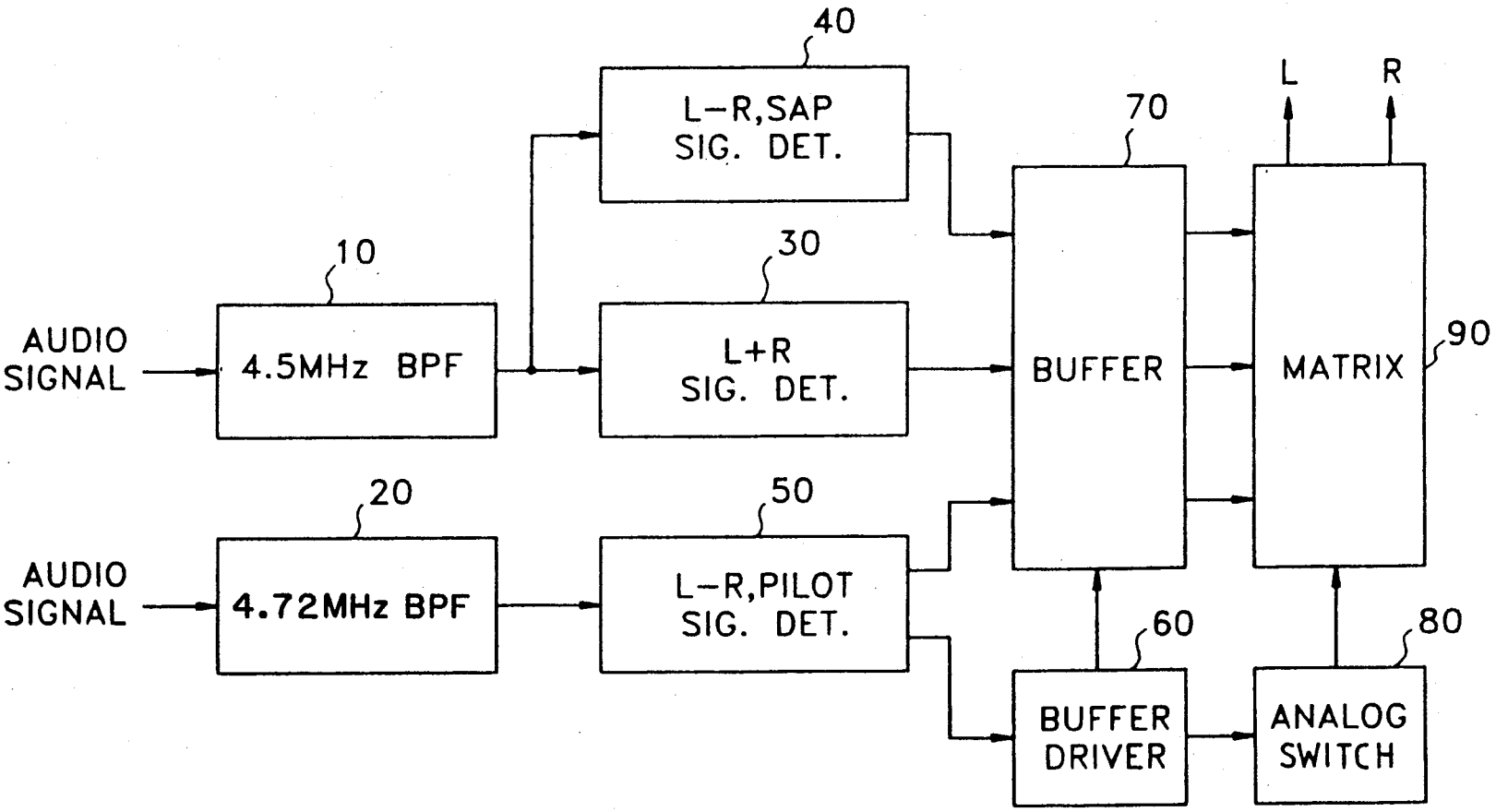
FIG. 1 is a block diagram of a compatible multivoice broadcasting receiver according to the present invention.

Referring to FIG. 1, the compatible multivoice broadcasting receiver according to the present invention comprises 4.5 MHz band pass filter 10, 4.72 MHz band pass filter 20, L+R signal detector 30, L−R and SAP signal detector 40, L−R and pilot signal detector 50, buffer driving section 60, buffer section 70, analog switch section 80 and matrix section 90.

Figure 2:
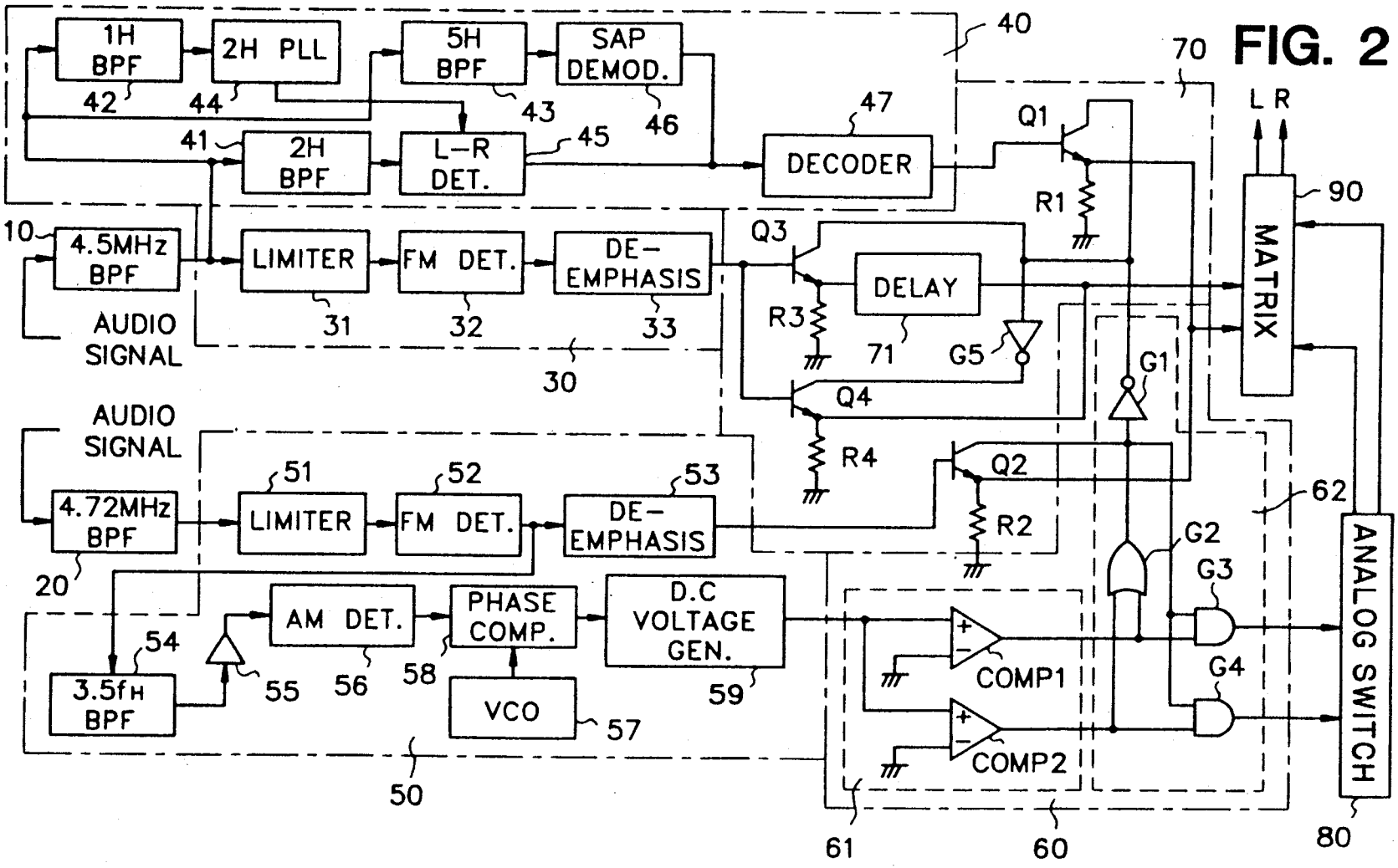
FIG. 2 is a circuit diagram of the compatible multivoice broadcasting receiver illustrated in FIG. 1.

The buffer driving section 60 incorporates a comparing section 61 in FIG. 2 that is composed of two comparators COMP1 and COMP2 that detect the relative relationship of the direct current voltage provided from the L−R and pilot signal detector 50, and logical operation section 62 that is composed of OR gate G2 that receives the signals outputted from the first and second comparators COMP1 and COMP2 and outputs the logical combination value, AND gate G3 that receives the values outputted from the OR gate G2 and the the first comparator COMP1 and outputs the logical combination value, AND gate G4 that receives the values outputted from the OR gate G2 and the second comparator COMP2 and outputs the logical combination value and inverter G1 that inverts the value outputted from the OR gate G2.

In addition, the buffer section 70 comprises time delay section (71) for matching the shifted phase of the signals outputted from the L−R and SAP signal detector 40, buffer transistor Q1 that is turned on and off by the signal outputted from the logical operation section 62, buffer transistor Q2 that turns the signal outputted from the L−R and pilot signal detector 50 on and off according to the signal outputted from the logical operation section 62, buffer transistor Q3 that operates only when the transistor Q1 is on and outputs the signal outputted from the L+R signal detector 30 to the time delay section 71, buffer transistor Q4 that outputs the signal outputted from the L+R signal detector 30, and inverter G5 that inhibits the two buffer transistors Q3 and Q4 from operating simultaneously.

The operation of the compatible multivoice broadcasting receiver according to the present invention having a composition as described above will be described below in detail.

FIG. 2 is a circuit diagram of the compatible multivoice broadcasting receiver as illustrated in FIG. 1.

Referring to FIG. 2, when the audio signal transmitted from the sender (not shown in the drawing) is input into 4.5 MHz band pass filter 10 and 4.72 MHz band pass filter 20, the audio signal is filtered through 4.5 MHz band pass filter 10 and 4.72 MHz band pass filter 20, respectively. The filtered signal through 4.5 MHz band pass filter 10 is outputted to amplitude limiter 31, 2H band pass filter 41, 1H band pass filter 42 and 5H band pass filter 43 respectively.

In the amplitude limiter 31, the signal outputted from the 4.5 MHz band pass filter 10 is limited to a certain level and outputted to FM detector 32.

In the FM detector 32, the audio signal is detected by converting the frequency variation of the signal output through the amplitude limiter 31 into a voltage variation signal, and then the FM detected audio signal is outputted to de-emphasis section 33.

In the de-emphasis section 33, in order to improve the ratio of signal to noise (SN ratio), the high band frequency emphasized in the pre-emphasis section of the sender (not shown in the drawings) is attenuated to restore the original frequency and outputted to the base terminals of the two buffer transistors Q3 and Q4 respectively. The collector terminal of the transistor Q3 is connected to the input terminal of the inverter G5 and the output terminal of the inverter G5 is connected to the collector terminal of the transistor Q4. Time delay section 71 is connected to emitter resistor R3 of the transistor Q3, and the signal outputted from the time delay section 71 is inputted to matrix section 90.

Meanwhile, in the 2H band pass filter 41, the signal outputted from the 4.5 MHz band pass filter 10 is transmitted and filtered to attain the frequency band corresponding to twice that of the horizontal synchronous frequency and output the filtered signal to the L−R detector 45. In the 1H band pass filter 42, the signal outputted from the 4.5 MHz band pass filter 10 is filtered to attain the frequency band corresponding to the horizontal synchronous frequency, and outputs the filtered signal to 2H phase locked loop (PLL) section 44. The 2H PLL section 44 outputs a signal that is phase-synchronized to a signal having a frequency band twice that of the horizontal synchronous frequency.

In the L−R detector 45, the signal outputted from the 2H band pass filter 41 is received and difference signal L−R of the left channel signal L and the right channel signal R that is synchronized to the output signal from the phase locked loop section 44 is detected. The L−R signal is the stereo signal of the U.S. multivoice broadcasting system.

Meanwhile, in 5H band pass filter 43, the signal outputted from the 4.5 MHz band pass filter 10 is filtered to have the frequency band corresponding to five times that of the horizontal synchronous frequency and outputs the filtered signal to SAP (Second Audio Program) demodulator 46. The SAP signal that is a bilingual signal is detected in the SAP demodulator 46 and outputted to the decoder section 47.

In the decoder section 47, in order to reduce the noises in the signal, the signals outputted from L−R detector 45 and SAP demodulator 46 are decoded and outputted to the base terminal of transistor Q1 in the buffer section 70.

Meanwhile, in the amplitude limiter 51 of the L−R and pilot signal detector 50, the audio signal filtered to attain a signal within the 4.72 MHz band is transmitted from 4.72 MHz band pass filter 20, the frequency portion beyond a certain range is eliminated and the amplitude variation is limited, and is output to FM detector 52.

In the FM detector 52, the audio signal is detected by converting the frequency variation of the signal outputted from the amplitude limiter 51 into a voltage variation signal, and supplied to de-emphasis section 53 and 3.5 fH band pass filter 54.

The signal outputted from de-emphasize section 53 that attenuates the high band frequency signal is inputted to the base terminal of transistor Q2 in buffer section 70.

In 3.5 fH band pass filter 54, filters a frequency band on which a pilot signal, that is, a discrimination signal that distinguishes between stereo broadcasting and bilingual broadcasting, is loaded and the filtered pilot signal is supplied to and amplified in amplifier 55.

In the AM detector section 56, the signal outputted from the amplifier 55 is rectified as the audio signal, that is, the original modulation signal, and is outputted to the phase comparator 58.

Meanwhile, the voltage controlled oscillator (VCO) 57, oscillates at 210 KHz, that is, the central frequency between 147 KHz stereo signal which is loaded on the pilot signal and 276 KHz BIL signal and supplies the oscillated frequency to phase comparator 58. Phase comparator 58 compares phase of the signal supplied from AM detector 56 with the oscillated frequency supplied from VCO 57.

The direct current voltage generator 59 provides the reference voltage, that is, the direct current voltage that corresponds to the 210 KHz oscillation frequency of the voltage controlled oscillator 57 for buffer driving section 60. The output signal of direct current voltage generator 59 is inputted to each of the positive terminals of the first comparator COMP1 and the second comparator COMP2 and the negative terminals of the comparators COMP1 and COMP2 are grounded.

The output signal of the first comparator COMP1 is inputted to one input terminal of OR gate G2 and one input terminal of, AND gate G3 and, the output signal of the second comparator COMP2 is inputted to the other input terminal of OR gate G2 and one input terminal of AND gate G4.

The output signal of OR gate G2 is inputted to the input terminal of the inverter G1, the collector terminal of the transistor Q2 and the other input terminals of two AND gates G3 and G4, respectively. The output values from the two AND gates G3 and G4 are inputted to the analog switch section 80, and the output value of the inverter G1 is inputted to the collector terminal of transistor Q1. Meanwhile, the emitter terminals of the transistors Q1 and Q2 in the buffer section 70 are connected to each other and the output signal of the emitter terminal is inputted to the matrix section 90.

Here, in Korean multivoice broadcasting, one of two comparators COMP1 and COMP2 in the comparing section 61 is operated when the user receives the stereo or BIL broadcast. At this time, the output of the OR gate G2 becomes "high", the output of the inverter G1 becomes "low". Accordingly, the transistor Q1 is turned off and the signal outputted from the L−R and SAP signal detector 40 is "0". However, transistor Q2 is turned on by the "high" signal, that is, the output signal of the OR gate G2 and supplies the output signal of the L−R and pilot signal detector 50 to the matrix section 90. In addition, in the case of Korean mono broadcasting, the transistor Q4 is turned on and supplies the output signal of the L+R signal detector 30 to the matrix section 90.

On the other hand, in American multivoice broadcasting, two comparators COMP1 and COMP2 both are inhibited from operating when the stereo and SAP broadcast is received. At this time, the output of OR gate G2 becomes "low" and the output of inverter G1 becomes "high". Accordingly, transistor Q3 is turned on and outputs the difference signal L−R of the left channel signal and the right channel signal, that is, a stereo signal and the SAP signal to the matrix section 90. The time delay section 71 is used to match the phase shift caused by the decoder section 47. In the American mono broadcasting system, the main channel signal L+R, that is, the sum signal L+R of the left channel signal and the right channel signal is outputted from the emitter terminal of the transistor Q3 to the matrix section 90 via the delay section 71.

In the matrix section 90, the output signals of the buffer section 70 are matrix-operated under the control of the analog switch section 80 that opens and closes the signals transmission and supplies left channel signal L and right channel signal R to listeners.

As described above, a compatible multivoice broadcasting receiver according to the present invention includes a common processing circuit for both the one-carrier component L+R of the Korean multivoice broadcasting and the main channel signal L+R of the American multivoice broadcasting system, thereby selectively receiving the Korean multivoice broadcasting and the American multivoice broadcasting.

What is claimed is:

1. A compatible multivoice broadcasting receiver capable of selectively receiving and processing a first format audio signal and a second format audio signal by commonly processing a main channel signal, said receiver comprising:

first band pass filter means for generating a first bandpassed signal by bandpass filtering an audio signal in a first frequency band;

second band pass filter means for generating a second bandpassed signal by bandpass filtering said audio signal in a second and different frequency band;

main signal detector means for detecting said main channel signal from said first bandpassed signal;

first secondary signal detector means for generating a first secondary detector signal by detecting a secondary signal in said first bandpassed signal;

second secondary signal detector means for generating a second secondary detector signal by detecting a secondary signal in said second bandpassed signal;

buffer means for selectively outputting one of said first secondary detector signal and said second secondary detector signal, and for selectively outputting one of said main channel signal and a delayed main channel signal, under the control of a buffer driving means;

said buffer driving means for driving said buffer means; and matrix means for generating a first audio signal and a second audio signal in response to said main channel signal and one of said first secondary detector signal and said second secondary detector signal; wherein said buffer means comprises:

delay means for delaying said main channel signal to produce said delayed main channel signal to match a phase shift generated by a decoder within said first secondary signal detector means, and for providing said delayed main channel signal to said matrix means;

a first buffer transistor that is turned on and off by an inverted first logical combination value to selectively pass said first secondary detector signal to said matrix means;

a secondary buffer transistor for selectively passing said second secondary detector signal to said matrix means in response to a first logical combination value;

a third buffer transistor that selectively supplies said main channel signal to said delay means in response to said inverted first logical combination value; and a fourth buffer transistor that selectively supplies said main channel signal to said matrix means in response to said first logical combination value.

2. The compatible multivoice broadcasting receiver claimed in claim 1, wherein said buffer driving means comprises:

comparing means comprising a first comparator generating a first comparator signal and a second comparator generating a second comparator signal, said first comparator and said second comparator detect a relative relationship of a direct current voltage supplied from said second secondary signal detector means; and a logical operation section comprising an OR gate that receives output signals of said first comparator and said second comparator and generates said first logical combination value, a first AND gate that receives said first logical combination value and said output signal of said first comparator to generate a second logical combination value, a second AND gate that receives said first logical combination value and said output signal of said second comparator to generate a third combination value, and an inverter that inverts said first logical combination value to generate said inverted first logical combination value.

3. The compatible multivoice broadcasting receiver claimed in claim 1, wherein said second secondary detector signal comprises a difference signal between a left channel signal and a right channel signal and a pilot signal for distinguishing whether said audio signal is one of a stereo signal and a bilingual signal.

4. The compatible multivoice broadcasting receiver claimed in claim 1, wherein said main channel signal is a sum of a left channel signal and a right channel signal.

5. The compatible multivoice broadcasting receiver claimed in claim 1, wherein said first band pass filter means has a pass band of 4.5 MHz.

6. The compatible multivoice broadcasting receiver claimed in claim 1, wherein said second band pass filter means has a pass band of 4.72 Mhz.

7. The compatible multivoice broadcasting receiver claimed in claim 1, wherein said first secondary detector signal is a difference signal between a left channel signal and a right channel signal.

* * * * *